United States Patent [19]

O'Brien et al.

[11] Patent Number: 4,575,909

[45] Date of Patent: Mar. 18, 1986

[54] APPARATUS FOR TREATING FABRIC FOR SHRINKAGE

[75] Inventors: Richard W. O'Brien, North Wilkesboro; Gwyn D. Rogers, Moravian Falls, both of N.C.

[73] Assignee: Modern Globe, Inc., North Wilkesboro, N.C.

[21] Appl. No.: 587,269

[22] Filed: Mar. 7, 1984

[51] Int. Cl.[4] ..... D06C 21/00

[52] U.S. Cl. ..... 26/18.6; 26/81

[58] Field of Search ..... 26/18.6, 81; 162/205, 162/206, 361

[56] References Cited

U.S. PATENT DOCUMENTS

| | | | |
|---|---|---|---|
| 1,992,194 | 2/1935 | Cluett | 26/18.6 |
| 2,021,975 | 11/1935 | Wrigley et al. | 26/18.6 |
| 3,260,778 | 7/1966 | Walton | 26/18.6 UX |
| 3,452,409 | 7/1969 | Trifunovic et al. | 26/18.6 |
| 3,939,537 | 2/1976 | Kreeft et al. | 26/18.6 |
| 4,156,955 | 6/1979 | Joy | 26/18.6 |
| 4,227,288 | 10/1980 | Moser | 26/18.6 |

FOREIGN PATENT DOCUMENTS

| | | | |
|---|---|---|---|
| 494132 | 3/1950 | Belgium | 26/18.6 |
| 718158 | 10/1931 | France | 26/18.6 |
| 1110734 | 10/1955 | France | 26/18.6 |
| 494423 | 5/1954 | Italy | 26/18.6 |
| 973023 | 10/1964 | United Kingdom | 26/18.6 |

*Primary Examiner*—Robert R. Mackey

*Attorney, Agent, or Firm*—Salter & Michaelson

[57] ABSTRACT

An apparatus is operative for treating both tubular and open-width fabrics for shrinkage. The apparatus includes an elongated continuously advancing belt, a nose roller which defines a curved area in the extent of the belt, and a low-friction compression shoe which is preferably made of tetrafluoroethylene. The compression shoe is received in substantially mating relation with the curved area of the belt and biased toward the belt in a compression area which includes a portion of the curved area and a portion of the area which is immediately past the curved area and which is preferably substantially straight. The belt has a significant thickness relative to the radius of the nose roller so that the outer surface of the belt travels at an increased rate of speed where it is stretched in the curved area. The apparatus is operative by longitudinally advancing an elongated fabric strip so that it is received in pressurized engagement between the belt and the shoe so that the fabric initially travels at a relatively high rate of speed with the belt over the curved area and so that thereafter the fabric is compressed as the outer surface of the belt is contracted as it returns to an unstretched condition in the substantially straight area.

3 Claims, 4 Drawing Figures

APPARATUS FOR TREATING FABRIC FOR SHRINKAGE

BACKGROUND AND SUMMARY OF THE INVENTION

The instant invention relates to textile manufacturing and processing and more particularly to an apparatus for treating fabrics for shrinkage.

It has long been recognized that many fabrics must be treated for shrinkage before they can be effectively used for garments or other items. This is largely because of the fact that yarns and fibers normally undergo a certain amount of stretching when they are woven or knitted into fabrics so that initially many knitted or woven fabrics comprise fibers which are in stretched and unrelaxed conditions. When these fabrics are subsequently exposed to processes such as washing or dyeing, the yarns and fibers thereof tend to return to their prestretched or relaxed conditions, and this causes shrinkage of the fabrics which may be highly irregular or uneven in many cases. Further, if these fabrics are made into garments, additional uneven shrinkage may occur when the garments are laundered. Accordingly, it has proven to be necessary to provide some means for treating fabrics for shrinkage before they are formed into garments so that the garments are not ruined or at least substantially distorted by subsequent shrinkage.

The U.S. Patent to Wehrman U.S. Pat. No. 3,007,223 discloses a "Process and Apparatus for Controlling Shrinkage and Otherwise Improving the Characteristics of Tubular Fabrics" and represents the closest prior art to the apparatus of the instant invention of which the applicants are aware. The device disclosed in this patent is operative for compressing tubular fabrics utilizing a pair of adjacent rollers having belts thereon and a freely floating form having a forward portion of reduced thickness which extends into the nip or gap between the rollers. A tubular fabric is received on the form so that the form is disposed in the tubular interior of the fabric, and, as a result, a single thickness or layer of fabric is interposed between each side of the form and the adjacent roller. During the operation of the apparatus, the rollers cooperate to draw the fabric and the form into the nip between the rollers. However, since the form is dimensioned so that it cannot fit between the rollers, the fabric slides over the surfaces of the form although the form is continually drawn toward the gap between the rollers by the belts and the fabric. As the fabric passes between the sides of the form and the belts, it is longitudinally compressed as the belts pass over the rollers. In this regard, the belts are formed so that the thicknesses thereof are of significant dimension relative to the diameters of the rollers, and, as a result, the linear speeds of the outer surfaces of the belts are substantially greater in the areas where the outer surfaces are stretched as they pass over the rollers than the linear speeds of the outer surfaces are in other straight sections of the belts. Accordingly, by introducing the fabric to the belts in the curved areas thereof defined by the rollers, the fabric travels initially at a relatively high rate of speed on the stretched outer surfaces of the belts, and then it travels at a relatively lower rate of speed when it reaches the straight areas of the belts, and the fabric is contracted or compressed as the outer belt surfaces return to their normal unstretched dispositions.

While apparatus of the type disclosed in the patent to Wehrmann has proven to be generally effective for longitudinally compressing tubular fabrics, it has proven to be relatively expensive to operate. Specifically, because of the way in which machines of this type have operated, they have been characterized by relatively high rates of belt wear; and, as a result, the belts of these machines have required frequent changing, and this has represented a substantial operating expense. This has been an inherent characteristic of machines of this type, because they have operated to effect compression by continually drawing a form into the nip or gap between a pair of rollers. This type of arrangement has provided relatively high uncontrollable compression pressures, and it has also caused high frictional belt wear any time that the form has accidentally engaged a belt. In particular, it has been found that high belt wear occurs particularly any time a defective area of a tubular fabric is encountered so that a portion of the fabric having one or more holes therein is compressed between the rollers with the form, whereby the form itself engages the rollers in the defective areas. As a result of the overall high belt wear rates experienced with machines of this type, and particularly as a result of belt wear caused in this manner, the belts of machines of this type have generally required changing after approximately 500 hours of use.

Safety has also been a problem with shrinkage treatment machines of the type disclosed in the aforementioned patent to Wehrmann, because they have operated with an exposed nip or gap between the rollers thereof. Specifically, instances have occurred wherein the hand of an operator has been caught in the nip or gap between a pair of rollers of a machine of this type, and before the machine could be stopped a substantial portion of the operator's arm was drawn into the machine, causing very serious injury to or, in some cases, the loss of the arm. Basically, this has been an inherent danger which has presented a substantial risk to operators of machines of this type.

The instant invention provides a novel shrinkage treatment apparatus which substantially overcomes these and other disadvantages of the heretofore known shrinkage treatment apparatus. The apparatus of the instant invention operates generally on the same basic principle as the apparatus disclosed in the Wehrmann patent, i.e., it operates by pressing a fabric into engagement with the outer surface of a curved section of a belt and then along a substantially straight section of the belt so that the fabric first travels at a relatively high rate of speed, and then at a somewhat slower rate to effect a longitudinal compression of the fabric. However, while the apparatus of the instant invention operates on this same general principle, structurally it differs substantially from the apparatus disclosed in Wehrmann, and as a result substantial advantages are provided in the apparatus of the instant invention.

The apparatus of the instant invention comprises a single continuously advancing resilient compression belt having inner and outer surfaces, a roller engaging the inner surface of the belt and defining a curved section in the extent thereof, a compression shoe which is receivable in substantially mating relation with the outer surface of the compression belt in a compression area thereof which includes at least a portion of the curved section and at least a portion of the area of the belt immediately past the curved section, and means mounting the compression shoe so that it is biased toward a position of substantially mating relation with the outer surface of the belt in the compression area. The apparatus further includes means for continuously longitudinally advancing an elongated fabric strip so that it is received in pressurized engagement between the curved belt section and the shoe and then advanced by the belt to a point in the travel thereof which is beyond the shoe. In the preferred embodiment of the apparatus, the shoe is formed of a low-friction polymer material such as tetrafluroethylene, i.e., Teflon (duPont trademark), and the shoe is resiliently biased toward the compression area with an inflatable member which is preferably pneumatically inflated to urge the compression shoe generally toward the curved section, preferably at an angle of approximately twenty degrees to the surface of the section of the belt which is immediately past the curved section. Also in the preferred embodiment, the compression shoe is slightly flexible so that it fully conforms to the configuration of the compression area to apply even pressure thereto.

For use and operation of the apparatus, an elongated fabric strip which may comprise either a single layer of fabric or a tubular strip which has been folded to a flat, two-layer configuration, is advanced to the apparatus so that it is received between the curved section of the belt and the compression shoe and so that it is advanced by the belt to a point in the travel thereof which is beyond the compression shoe. Accordingly, the fabric first travels at a relatively high rate of speed between the curved section of the belt and the compression shoe; and when the belt thereafter travels in a substantially straight direction so that the outer surface of the belt is compressed or returned to its normal disposition, the fabric which is interposed in pressurized engagement between the shoe and the belt is also compressed.

While the broad general concept of compressing a fabric by urging it into pressurized engagement with a resilient belt as the belt passes over a roller is disclosed in the aforementioned patent to Wehrmann, the apparatus of the instant invention has substantial advantages over the known apparatus. Specifically, by utilizing a single belt, a compression shoe, and a means for resiliently biasing the compression shoe towards the compression area of the belt, a controlled amount of dynamic pressure can be applied to a fabric with the shoe, and the pressure can be applied in a predetermined direction. Also, because the shoe does not have a forward portion of reduced thickness, such as the insert utilized in the apparatus of Wehrmann, it is possible for the shoe to be constructed from a more delicate low-friction material, such as Teflon (duPont TM), or some other known low-friction polymer. As a result of these features, even if the shoe engages the belt in the areas adjacent the edges of the strip or if it engages the belt inadvertently as a result of imperfections in the strip, the belt is not substantially damaged by the shoe. The chances of causing damage to the belt are even further reduced when the shoe is constructed so that it is slightly resiliently flexible whereby the shoe conforms to the configuration of the belt to assure that the pressures between the shoe and the belt are applied evenly, and this also obviously provides more uniform compression of the fabric.

As a result of these differences between the apparatus of the instant invention and the heretofore known apparatus for treating fabrics for shrinkage, a number of benefits are realized with the apparatus of the instant invention. Specifically, it has been found that the apparatus of the instant invention can effectively operate at substantially higher throughput rates than the heretofore known Wehrmann-type apparatus. Further, since the apparatus of the instant invention only utilizes a single belt, the overall cost of manufacturing the apparatus of the instant invention is approximately 40% less than the cost of manufacturing a Wehrmann-type apparatus. Further, because the apparatus of the instant invention only requires energy for driving a single belt, energy costs for operating the apparatus are reduced by as much as 50%. In addition, the belt life experienced with the apparatus of the instant invention is normally at least double the belt life experienced with the heretofore-known apparatus; and since the apparatus of the instant invention requires only a single belt instead of two belts, the overall belt expense is generally less than one fourth of the operating expense of a conventional apparatus.

In addition to these economic benefits, the apparatus of the instant invention also has substantial advantages from a safety standpoint. Substantially all of the heretofore-known Wehrmann-type apparatus for treating tubular fabrics for shrinkage have operated with dangerous open nips or gaps between the rollers thereof, and instances have occurred wherein the fingers and arms of persons have actually been drawn into machines of this kind. Accidents of this type are virtually impossible with the apparatus of the instant invention, since it operates with a single roller, and therefore it does not have an open nip area.

Further, virtually all of the heretofore-known apparatus for treating fabrics for shrinkage have been operable for treating exclusively tubular fabrics, and they have only been operative for treating tubular fabrics of different widths by changing to different-sizes of feed apparatus. On the other hand, the apparatus of the instant invention can accommodate both tubular and open-width fabrics, and the widths of fabrics can be changed while the machine is in operation since mechanical equipment changes are not required.

Accordingly, it is a primary object of the instant invention to provide an improved apparatus for treating fabrics for shrinkage.

Another object of the instant invention is to provide a shrinkage-treatment apparatus which includes a single roller and a low-friction compression shoe.

Another object of the instant invention is to provide an apparatus for shrinkage treatment of fabrics which can operate with reduced maintenance costs.

An even further object of the instant invention is to provide an apparatus which is operative for shrinkage treatment of tubular fabrics with increased safety.

A still further object of the instant invention is to provide an apparatus for shrinkage treatment of fabrics which can be used on both tubular and open-width fabrics.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
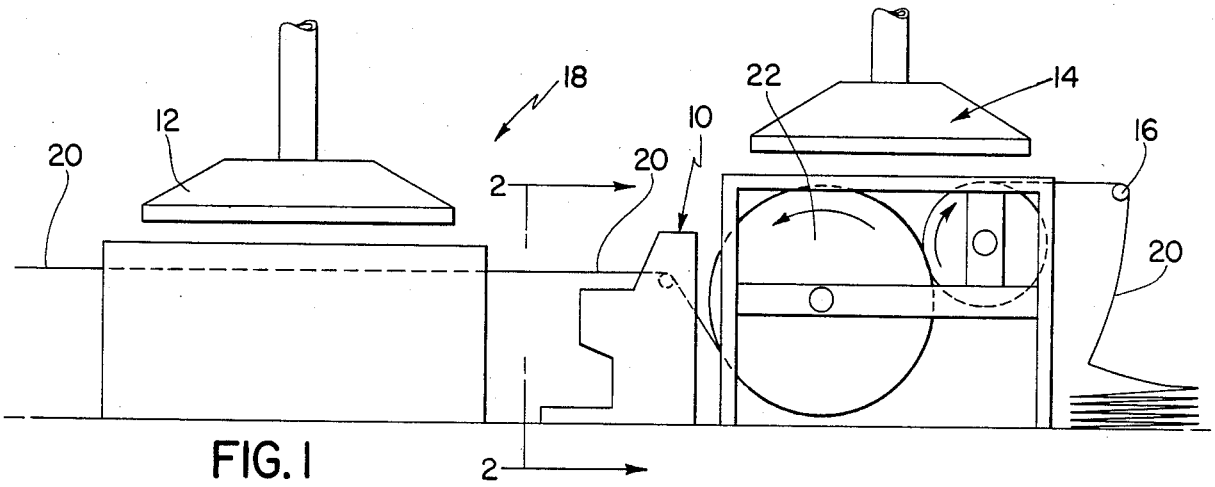
FIG. 1 is a schematic view of a shrinkage-treatment system which includes the apparatus of the instant invention.
Figure 2:
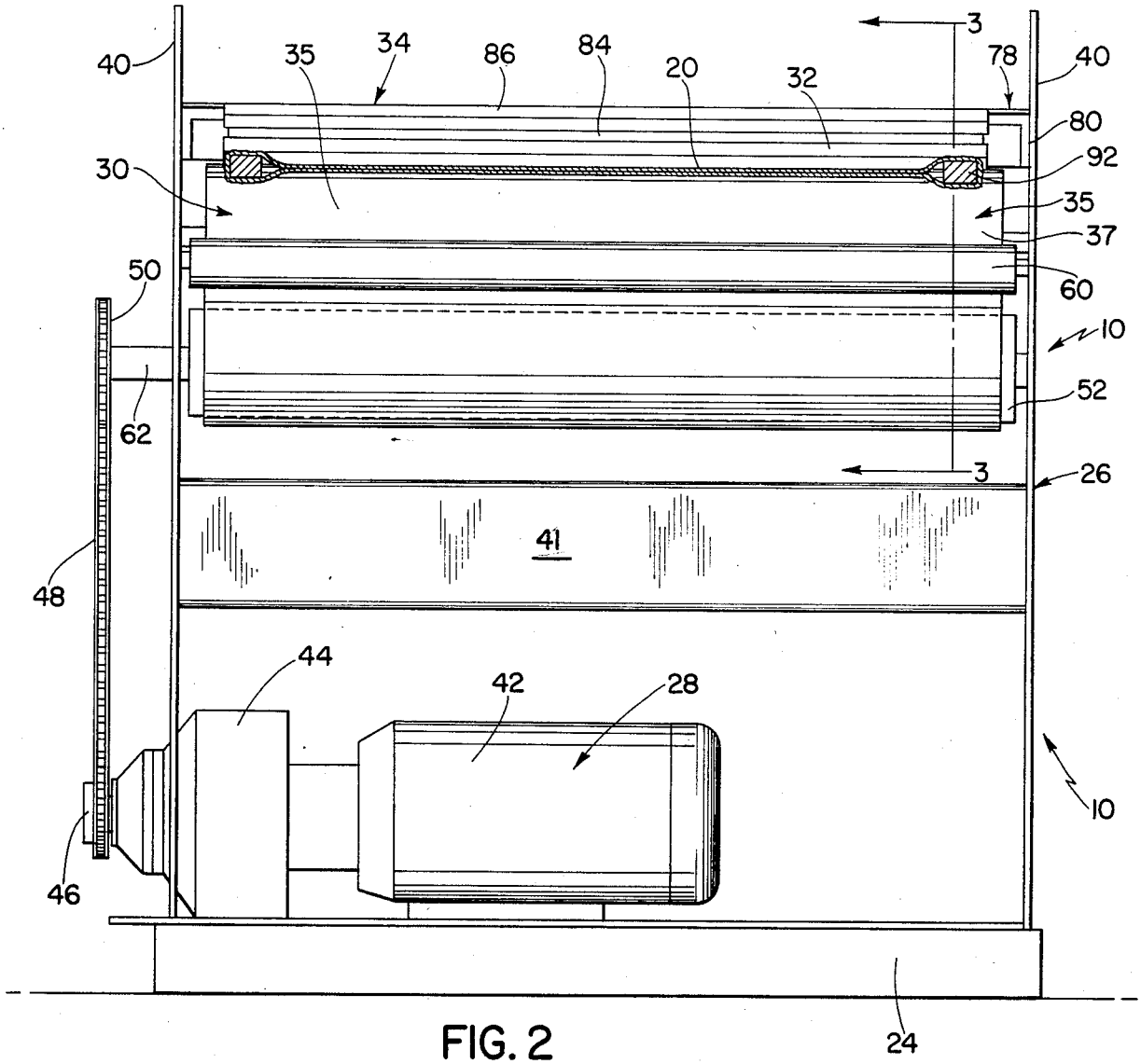
FIG. 2 is a front elevational view of the apparatus of the instant invention.
Figure 3:
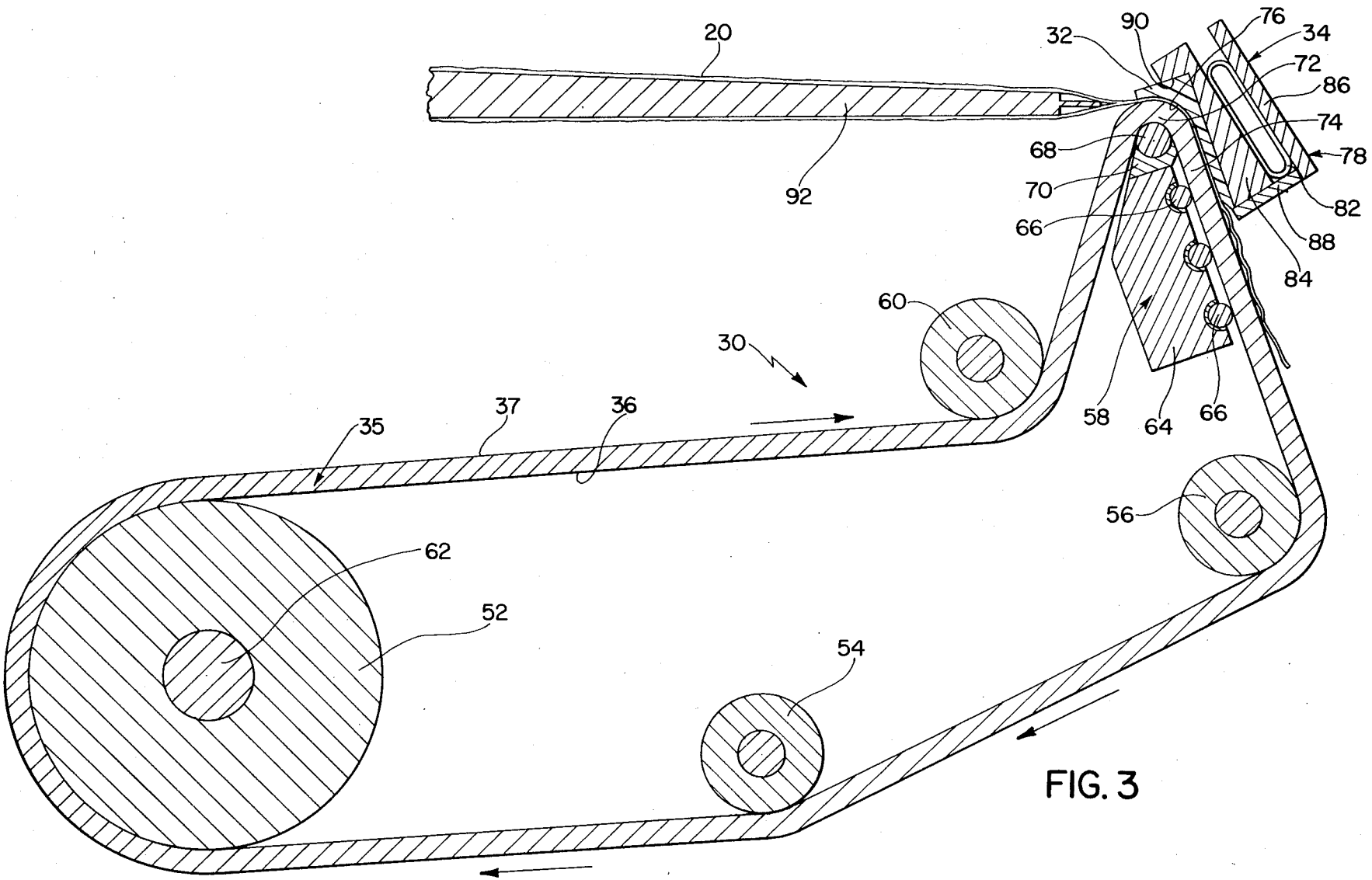
FIG. 3 is a sectional view taken along line 3—3 in FIG. 2.

Referring now to the drawings, the apparatus of the instant invention is illustrated and generally indicated at 10 in FIGS. 1 through 3. The apparatus 10 is illustrated in FIG. 1 in combination with an R.F. dryer 12, a Palmer unit 14, and a lay-up apparatus 16, all of which cooperate to define a shrinkage treatment system generally indicated at 18, it being understood that the use of the apparatus 10 in other types of shrinkage treatment systems is also contemplated. In operation of the system 18, a fabric 20 which generally has a high-moisture content is longitudinally advanced to the R.F. (radiofrequency) dryer 12 which operates to dry the fabric 20 to a predetermined moisture content (preferably approximately 15% of saturation), and thereafter the fabric 20 is advanced to the apparatus 10 where it is longitudinally compressed. The compressed fabric 20 is then fed to the Palmer unit 14 which comprises a steam-heated drum 22 for drying the fabric 20 and setting the compression provided by the apparatus 10, and the dried fabric 20 is then layed up or folded by the apparatus 16.

The apparatus 10 operates on the general principle that when a resiliently flexible belt having a relatively high thickness passes over a relatively small-diameter roller so that the roller defines a curved section in the belt, the outer surface of the belt travels at a substantially higher rate of linear speed in the curved section than it does in other less-curved or straight sections of the belt. Accordingly, if a fabric is maintained in pressurized contact with the belt in the transition area where it passes from the curved section to a substantially straight section, the fabric is longitudinally compressed when the outer surface of the belt contracts as it passes to the substantially straight section.

Figure 4:
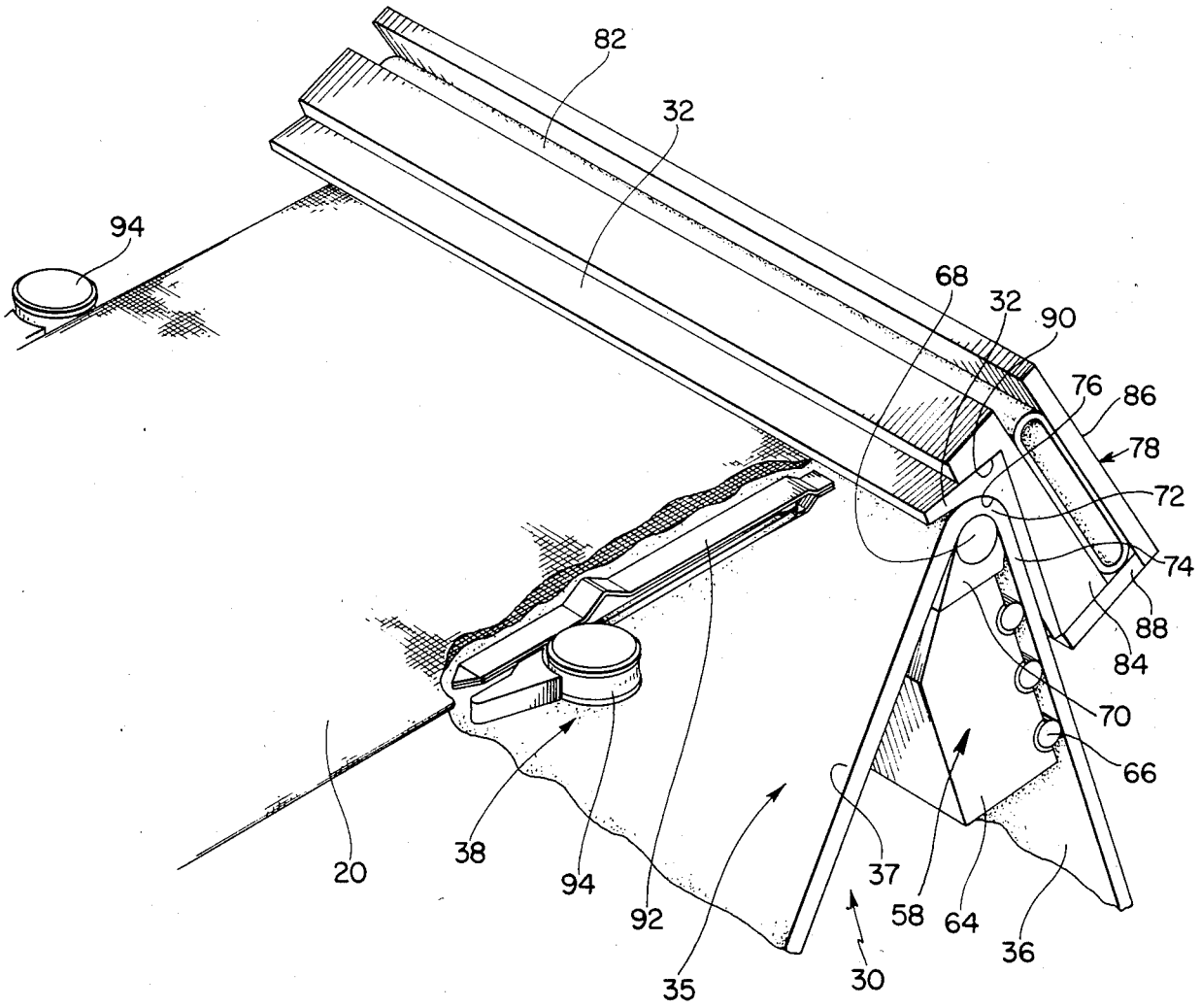
FIG. 4 is a fragmentary perspective view of the apparatus in the operation thereof for compressing a tubular fabric.

Referring now to FIGS. 2 through 4, the apparatus 10 comprises a base 24, a frame assembly generally indicated at 26, a drive assembly generally indicated at 28, a belt assembly generally indicated at 30, a compression shoe 32, and a compression shoe mounting assembly generally indicated at 34. The drive assembly 28 is mounted on the base 24, and the frame assembly 26 extends upwardly from the base 24. The belt assembly 30 is mounted on the frame assembly 26, and it communicates with the drive assembly 28 for driving a compression belt 35 having inner and outer surfaces 36 and 37, respectively. The shoe mounting assembly 34 mounts the shoe 32 so that it is biased toward the belt 35 in a curved area thereof which will hereinafter be more fully described. For operation of the apparatus 10, the fabric 20 is longitudinally advanced to the belt 35 with a feed assembly 38 so that the fabric 20 is received between the shoe 32 and the belt 35, and, accordingly, as the fabric 20 passes through the apparatus 10, it is longitudinally compacted or compressed in order to provide a controlled shrinkage treatment of the fabric 20.

The base 24 provides a base structure for the apparatus 10 for supporting the drive assembly 28 and the frame assembly 26. The frame assembly 26 comprises a pair of spaced walls 40 which extend upwardly from the base 24 and a cross member 41 which extends between the walls 40. The belt assembly 30 and the shoe mounting assembly 34 are mounted between the walls 40, as will hereinafter be more fully set forth.

The drive assembly 28 comprises a drive motor 42 to which a speed reducer 44 is connected, a drive sprocket 46, a drive chain 48, and a roller sprocket 50. The drive sprocket 46 is mounted on the output shaft of the speed reducer 44, and the chain 48 communicates rotation from the drive sprocket 46 to the roller sprocket 50 in order to effect movement of the belt 35 in the belt assembly 30 in a manner which will hereinafter be more fully described. Accordingly, the belt assembly 30 is driven by the motor 28 at a rate which is controllable through the speed reducer 44.

The belt assembly 30 comprises the belt 35, a drive roller 52, a tracking roller 54, an idler roller 56, a nose bar assembly generally indicated at 58, and a tensioning roller 60. The rollers 52, 54, 56, and 60 and the nose bar assembly 58 are mounted between the walls 40, and the belt 35 is received on the rollers 52, 54, 56, and 60 and on the nose bar assembly 58 in the manner illustrated in FIG. 3. In this regard, the rollers 52, 54, and 56 and the nose bar assembly 58 are preferably positioned so that they engage the inner surface 36 of the belt 35, whereas the roller 60 is positioned to engage the outer surface 37 of the belt 35. The drive roller 52 is mounted on a drive shaft 62 which is journalled in the walls 40, and the roller sprocket 50 is mounted on the shaft 62 in order to effect rotation of the drive roller 52. The tracking roller 54 is also journalled in the walls 40, but one end of the roller 54 is preferably adjustably mounted (not shown) in order to change the angle of the roller 54 to effect proper tracking of the belt 35 in a well-known manner. The idler roller 56 is journalled in the walls 40, and the tensioning roller 60 is also journalled in the walls 40, but it is adjustably biased towards the belt 35 (not shown) in order to maintain the desired level of tension therein. The nose bar assembly 58 comprises a wedge-shaped nose bar element 64 on which a plurality of secondary idler rollers 66 are mounted, and a nose roller 68 which is journalled in a roller mount 70. The roller mount 70 is secured to the wedge bar element 64 so that the roller 68 is disposed at the tapered end thereof, and the secondary rollers 66 are journalled in the nose bar element 64 so that they are disposed in substantially parallel relation to each other and to the nose roller 68 along an outwardly facing side of the nose bar assembly 58. The nose bar assembly 58 is mounted between the walls 40 so that the nose roller 68 engages the inner surface 36 of the belt 35 in order to define a curved area 72 in the belt 35 which preferably forms an arcuate sector of at least 90°, and the secondary idler rollers 66 also engage the inner surface 36 of the belt 35 so that they cooperate to define an area 74 of the belt 35 which is substantially straight or which at least has a reduced degree of curvature relative to the curved area 72 and which is supported by the rollers 66. In this regard, preferably the belt 35 has a thickness of approximately ½ inch, the nose roller 68 preferably has a radius of approximately ⅜ inch, so that the thickness of the belt 35 is of significant dimension relative to the radius of the roller 68 in order to assure a significant increase in the linear speed of the outer surface 37 in the curved section 72. Obviously, however, it will be understood that the construction of the apparatus 10 with other dimensions for the belt 35 and the roller 68 is contemplated.

The shoe 32 which is most clearly illustrated in FIGS. 3 and 4 comprises an elongated member which is mounted in substantially transverse relation to the outer surface 37 of the belt 35 adjacent the areas 72 and 74. The shoe 32 is of generally L-shaped sectional configuration, and it has a substantially smooth arcuate inner compression surface 76. The shoe 32 is configured so that the compression surface 76 is receivable in substantially mating relation with the outer surface 37 of the belt 35 in a compression area of the belt 35 which includes a portion of the curved area 72, preferably at least a 90° sector thereof, and a portion of the substantially straight area 74. Preferably the shoe 32 is constructed of a low-friction polymer material, such as tetrafluoroethylene, i.e., Teflon (duPont trademark) so that the surface 76 has a low-friction coefficient, whereby the frictional resistance applied to the fabric 20 by the shoe 32 is minimized. While preferably the entire shoe 32 is constructed of a low-friction polymer material, it will be understood that other embodiments of the shoe 32 which include low-friction coatings on the surface 76 are also contemplated. Further, the shoe 32 is preferably configured so that it is rugged enough to withstand processing pressures over prolonged periods of use in the apparatus 10, although it is preferably slightly flexible and of sufficient thickness so that it can deform to fully conform to the configuration of the belt 35 in the areas 72 and 74. In this connection, it has been found that because the belt 35 is stretched as it passes over the roller 68, the outer surface 37 does not actually project a true radius in the area 72. By utilizing a shoe 32 which is slightly flexible or deformable, the shoe 32 compensates for this effect so that the surface 76 can be maintained in uniformly pressurized engagement with the fabric 20 adjacent the areas 72 and 74. It has been found that when the shoe 32 is constructed of Teflon (duPont TM), it has sufficient natural flexibility to achieve uniform pressurized engagement in this manner.

The mounting assembly 34 is mounted between the walls 40, and it is operative for mounting the shoe 32 so that it is biased toward the belt 35 in a direction which assures that the surface 76 is urged to a position of mating relation with the belt 35 in the areas 72 and 74. The mounting assembly 34 comprises a housing 78 which is mounted on the walls 40 as at 80, a resiliently compressible inflatable member 82 which is received in the housing 78, and a compression shoe buffer 84 which is preferably made of a rubberized material. The housing 78 comprises a backup plate 86 which extends between the walls 40 at an angle which is preferably approximately twenty degrees to the substantially straight area 74 of the belt 35, and a retainer wall 88 which extends toward the belt 35 in substantially perpendicular relation to the backup plate 86. The inflatable member 82 is received in the housing 78 so that it extends substantially along the entire extent thereof between the walls 40. The inflatable member 82 is preferably constructed of a flexible but durable material, such as a section of flexible fire hose or the like, in an enclosed tubular configuration. The inflatable member 82 is preferably sealed at the opposite ends thereof and connected to a controlled source of pressurized air (not shown) for providing controlled pneumatic inflation of the member 82. The buffer 84 is disposed between the inflatable member 82 and the shoe 32, and it is formed with a notch 90 therein for receiving the shoe 32. Preferably the notch 90 and the shoe 32 are formed so that when the shoe 32 is received in the notch 90 the surface of the buffer 84 which faces the inflatable member 82 is at an angle of approximately twenty degrees to the area 74 of the belt 35. Accordingly, the surface of the buffer 84 which faces the inflatable member 82 is preferably substantially parallel to the backup plate 86; and when the inflatable member 82 is inflated, it tends to urge the shoe 32 toward the area 74 of the belt 35 in a direction which is substantially perpendicular to the backup plate 86 or at an angle of approximately 70° with respect to the area 74 so that it urges the shoe 32 slightly in the direction of the travel of the belt 35 to assure that effective pressure is applied by the shoe 32 in the area 72. In this regard, it has been found that a pressure of approximately 20 psi on the shoe 32 is preferable, although the operation of the apparatus 10 with other amounts of pressure on the shoe 32 is contemplated.

The drive assembly 38 is preferably of the type disclosed in the U.S. Patent to Frezza U.S. Pat. No. 4,192,045 and comprises a spreader frame 92 and a pair of edge drive rolls 94. The fabric 20 in the embodiment herein illustrated comprises a tubular fabric, and hence the spreader frame 92 is received in the tubular interior of the fabric 20 and sets the width of the fabric 20 which is fed to the apparatus. The edge drive rolls 94 engage the edges of the fabric 20 to advance it toward the belt 35 and the shoe 32. It will be understood, however, that the use of other types of drive assemblies in combination with the apparatus 10 for treating both tubular and open-width fabrics is also contemplated. For example, the use of the apparatus 10 in combination with a scroll centering roll device, uncurlers, cloth guiders, and a pin or clip rail delivery system for processing open-width fabrics is contemplated.

For use and operation of the apparatus 10, the drive rolls 94 of the feeder assembly 38 engage the opposite edges of the tubular fabric strip 20 to advance it to the belt 35 so that it is received between the shoe 32 and the belt 35 in the curved area 72. Since the fabric 20 is urged against the belt 35 with the shoe 32, and since the surface 76 of the shoe 32 is a relatively low-friction surface, whereas the surface 37 is a relatively high-friction surface, the fabric 20 travels at the same speed as the surface 37. Further, because the outer surface 37 travels at an increased rate of speed in the curved area 72 as a result of the thickness of the belt 35 relative to the diameter of the nose roller 68, the outer surface 37 is forced into a stretched disposition as it travels over the roller 68, and therefore it travels at an increased rate of speed, and the fabric 20 travels at the same rate of speed. However, when the belt 35 passes to the substantially straight area 74 so that the outer surface 37 is contracted as it returns to its normal, unstretched condition, the fabric 20 is longitudinally compressed as it is also contracted. In addition, the firm, even pressure applied to the fabric by the shoe assures that the fabric 20 does not slip on the surface 37 so that the cloth width is also maintained uniform.

Accordingly, it is seen that the instant invention provides an effective apparatus for longitudinally compressing both tubular and open-width fabrics in order to treat such fabrics for shrinkage. The shoe mounting assembly 34 operates to urge the shoe 32 toward the belt 35 in the areas 72 and 74 in a manner which provides even, controlled pressure on the shoe 32 at a desired angle relative to the substantially straight area 74 of the belt 35. Because the shoe 32 does not have to be configured so that it can be received between a pair of belts, it does not have to be constructed of a metal or a heavily reinforced resin, and therefore the shoe 32 can be constructed of a low-friction polymer, such as tetrafluoroethylene. This provides substantially reduced friction between the fabric 20 and the surface 76 of the shoe 32, and it also substantially reduces the tendency of the belt 35 to wear whenever it is contacted by the shoe 32. Further, when the shoe 32 is constructed of tetrafluoroethylene, it is slightly flexible so that it fully conforms to the configuration of the belt 35 in the areas 72 and 74 in order to apply even pressure thereto so that uniform compression of the fabric 20 is assured. In this connection, the angle of the pressure which is applied to the shoe 32 assures that the shoe 32 is not distorted an excessive amount, although it nevertheless permits the shoe 32 to be drawn slightly in the direction of the travel of the belt 35 and the fabric 20 in order to achieve sufficient pressure between the shoe 32 and the belt 35 in the curved area 72.

The apparatus of the instant invention also provides several other substantial advantages over the known shrinkage treatment apparatus. First, since the apparatus 10 only requires a single belt instead of two belts, the apparatus of the instant invention can be manufactured for approximately 40% less than the heretofore known fabric compression apparatus. Further, since belt wear is substantially reduced with the apparatus of the instant invention, and since the apparatus 10 only requires a single belt, belt replacement costs for the apparatus of the instant invention are generally less than one fourth of the belt replacement costs for the heretofore-known apparatus. Further, since the apparatus of the instant invention only includes a single belt, the energy costs for operating the apparatus 10 are substantially reduced as well. It has also been found that the apparatus 10 can operate with substantially higher throughput rates than the heretofore known apparatus. In addition, the apparatus 10 is substantially safer to operate than the conventional apparatus since it does not comprise a pair of belts on rollers with an open nip area. Hence it is seen that the instant invention provides an effective apparatus for compressing fabrics which has substantial advantages over the heretofore-known shrinkage apparatus. Accordingly, the instant invention represents a significant advancement in the textile art which has substantial merit from both a commercial standpoint as well as from a safety standpoint.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What we claim is:

1. An apparatus for treating an elongated fabric strip for shrinkage and the like comprising a continuously advancing resilient belt having inner and outer surfaces, a roller engaging the inner surface of said belt and defining a curved area in the extent thereof, said belt having an area of substantially reduced curvature immediately beyond said curved area and having a thickness which is of significant dimension relative to the radius of said roller so that the linear speed of said outer surface in said curved area is significantly greater than the linear speed of said outer surface in said area of reduced curvature, means supporting the inner surface of said belt in said area of reduced curvature, a compression shoe having a low-friction compression surface thereon, said shoe being configured and dimensioned so that said compression surface is receivable in substantially mating relation with said outer surface of said belt in a compression area which extends from an intermediate point in said curved area to a point in said area of reduced curvature which is spaced from said curved area, means for mounting said shoe so that it is disposed in substantially mating relation to said belt outer surface in said compression area and resiliently biased toward said area of reduced curvature, said mounting means comprising a buffer made of a rubberized material, an inflatable member, a backup plate and a retainer wall, said retainer wall extending angularly from said backup plate toward said area of reduced curvature and cooperating with said backup plate to mount said inflatable member and said buffer so that said inflatable member biases said buffer toward said shoe to thereby bias said shoe toward said area of reduced curvature, and means for continuously longitudinally advancing said strip to said belt and said shoe so that substantially said entire strip is received in pressurized engagement between said belt and said shoe and advanced by said belt to a point in the travel thereof which is beyond said shoe.

2. An apparatus for treating an elongated fabric strip for shrinkage and the like comprising a continuously advancing resilient belt having inner and outer surfaces, a roller engaging the inner surface of said belt and defining a curved area in the extent thereof, said belt having an area which is substantially straight immediately beyond said curved area and having a thickness which is of significant dimension relative to the radius of said roller so that the linear speed of said outer surface in said curved area is significantly greater than the linear speed of said outer surface in said straight area, means supporting the inner surface of said belt in said straight area, a compression shoe having a low-friction compression surface thereon, said shoe being configured and dimensioned so that said compression surface is receivable in substantially mating relation with said outer surface of said belt in a compression area which extends from an intermediate point in said curved area to a point in said straight area which is spaced from said curved area, means for mounting said shoe so that it is disposed in substantially mating relation to said belt outer surface in said compression area and resiliently biased toward said straight area, said shoe mounting means comprising a compressible inflated member and means mounting said inflated member so that it biases said shoe toward said straight area of said belt at an angle of approximately 70° thereto to urge said shoe toward said belt and also slightly in the direction of travel of said belt, said shoe being made of a material which is slightly deformable and being of a sufficient thickness to permit it to deform slightly in the direction of travel of said strip so that the friction between said shoe and said strip as said strip is passed over said curved area causes said shoe to be deformed slightly and thereby drawn into pressurized mating relation with said strip on said belt in said curved area and means for continuously longitudinally advancing said strip to said belt and said shoe so that substantially said entire strip is received in pressurized engagement between said belt and said shoe and advanced by said belt to a point in the travel thereof which is beyond said shoe.

3. An apparatus for treating an elongated fabric strip for shrinkage and the like comprising a continuously advancing resilient belt having inner and outer surfaces, a roller engaging the inner surface of said belt and defining a curved area in the extent thereof, said belt having an area of substantially reduced curvature immediately beyond said curved area and having a thickness which is of significant dimension relative to the radius of said roller so that the linear speed of said outer surface in said curved area is significantly greater than the linear speed of said outer surface in said area of reduced curvature, means supporting the inner surface of said belt in said area of reduced curvature, a compression shoe having a low-friction compression surface thereon, said shoe being configured and dimensioned so that said compression surface is receivable in substantially mating relation with said outer surface of said belt in a compression area which extends from an intermediate point in said curved area to a point in said area of reduced curvature which is spaced from said curved area, means for mounting said shoe so that it is disposed in substantially mating relation to said belt outer surface in said compression area and resiliently biased toward said area of reduced curvature and also slightly in the direction of travel of said belt, and means for continuously longitudinally advancing said strip to said belt and said shoe so that substantially said entire strip is received in pressurized engagement between said belt and said shoe and advanced by said belt to a point in the travel thereof which is beyond said shoe, said shoe being made of a material which is slightly deformable and being of a sufficient thickness to permit it to deform slightly in the direction of travel of said strip so that the friction between said shoe and said strip as said strip is passed over said curved area causes said shoe to be deformed slightly and thereby drawn into pressurized mating relation with said strip on said belt in said curved area.

* * * * *